United States Patent [19]

Guinan

[11] 4,389,555

[45] Jun. 21, 1983

[54] CIRCUIT BREAKER WITH INCREASED ELECTRICAL SPACING

[75] Inventor: Thomas Guinan, Hamilton Township, Mercer County, N.J.

[73] Assignee: Heinemann Electric Company, Lawrenceville, N.J.

[21] Appl. No.: 365,516

[22] Filed: Apr. 5, 1982

[51] Int. Cl.[3] ..... H07H 9/04

[52] U.S. Cl. ..... 200/303; 200/293; 200/306

[58] Field of Search ..... 335/202; 200/302–307, 200/296, 297, 293, 144 R, 339

[56] References Cited

U.S. PATENT DOCUMENTS

| | | | |
|---|---|---|---|
| 3,144,506 | 8/1964 | Gunthel, Jr. | 174/92 X |
| 3,422,235 | 1/1969 | Camp | 200/303 X |
| 3,571,545 | 3/1971 | Haderer | 200/303 |
| 3,632,927 | 1/1972 | Gribble | 200/144 R |
| 3,655,925 | 4/1972 | Lincoln et al. | 200/11 TW |
| 3,739,122 | 6/1973 | Pierzchala | 200/144 R X |
| 3,786,380 | 1/1974 | Harper | 335/9 |
| 4,075,446 | 2/1978 | Aadahl | 200/306 X |
| 4,245,274 | 1/1981 | MacDonald et al. | 361/399 X |
| 4,319,107 | 3/1982 | Haskins | 200/303 |
| 9,112,270 | 9/1978 | Rys | 200/307 X |

*Primary Examiner*—John W. Shepperd
*Assistant Examiner*—Ernest G. Cusick
*Attorney, Agent, or Firm*—Joseph G. Denny, III; Peter J. Patane

[57] ABSTRACT

A circuit breaker in which the case comprises two half-cases abutting together to jointly form the case. A handle link includes a handle with a portion extending through the half-cases. The half-cases have abutting, interfitting tongue and groove portions to increase the creepage and clearance distances from outside the circuit breaker to the closest electrically energized parts within the circuit breaker. Further the handle link and the half-cases have a pivotally semi-circular interfitting tongue and groove connection. The abutting, interfitting tongue and groove portions of the half-cases are disposed on both sides of said semi-circular connection and pivotally adjacent thereto so as to form a tongue and groove connection at the opening of the case through which the handle extends and on either side thereof. Also, the handle link has pintles pivotally extending into recesses provided therefor in the half-cases.

4 Claims, 4 Drawing Figures

CIRCUIT BREAKER WITH INCREASED ELECTRICAL SPACING

BACKGROUND OF THE INVENTION

This invention relates generally to molded case electrical circuit breakers of the type wherein the case is formed by two half-cases abutted together to jointly form the case and the meeting of a European safety standard for such circuit breakers by economically modifying a known case.

With the increasing emphasis on exports so as to minimize the balance of payments trade deficit of our country, engineers involved in the design of electrical equipment for export such as circuit breakers, must design the equipment to comply not only with the requirements of the United States National Electrical Code (NEC) and of Underwriters Laboratories, Inc. (UL), but also of other countries.

Guidance for design engineers can be found in the safety standards of the International Electro Technical Commission (IEC) and the safety standards set forth in the West German Verband Deutscher Elektrotechniker e.V. (VDE) codes.

For circuit breakers, the IEC and VDE codes require 8 mm clearance and creepage distances between any operator accessible part of the circuit breaker and a hazardous voltage within the circuit breaker.

This invention is directed to providing such minimum 8 mm clearance and creepage distances in molded case circuit breakers of existing design and construction with a minimum of change in the design and construction thereof.

Additional information on the IEC and VDE codes may, of course, be obtained from the codes themselves and from an article entitled "Meeting Circuit Breaker Safety Standards at Home and Abroad" appearing in Design News issue of Sept. 21, 1981 at pages 86 to 92, inclusive.

BRIEF SUMMARY OF THE INVENTION

It is an object of this invention to provide a known molded case circuit breaker with means for increasing the clearance and creepage distances between any operator accessible part of the circuit breaker and a hazardous voltage within the circuit breaker to at least 8 mm so as to comply with the IEC and VDE codes.

This invention is embodied in a circuit breaker for mounting to a panel comprising a case (formed by two abutting half-cases) and an electromagnetic device comprising a solenoid coil and an armature. The armature is electrically energized and the overlying portions of the abutting half-cases are provided with a tongue and groove construction which increases the clearance and creepage distances to above the required minimum.

Likewise, the abutting half-cases have been modified alongside where the handle exits the case to provide with the handle a tongue and groove construction between opposite sides of the handle and the abutting half-case and the handle link has been pivoted solely on the adjacent half-cases instead of being also supported on the metal supporting frame plates of the previous construction.

The previous construction is shown in U.S. Pat. No. 3,329,913, issued in the name of William W. Camp, but assigned to the Heinemann Electric Company.

The foregoing and other objects of this invention, the principles of this invention, and the best modes in which I have contemplated applying such principles will more fully appear from the following description and accompanying drawings in illustration thereof.

BRIEF DESCRIPTION OF THE VIEWS

DESCRIPTION OF THE PREFERRED EMBODIMENTS

Figure 1:
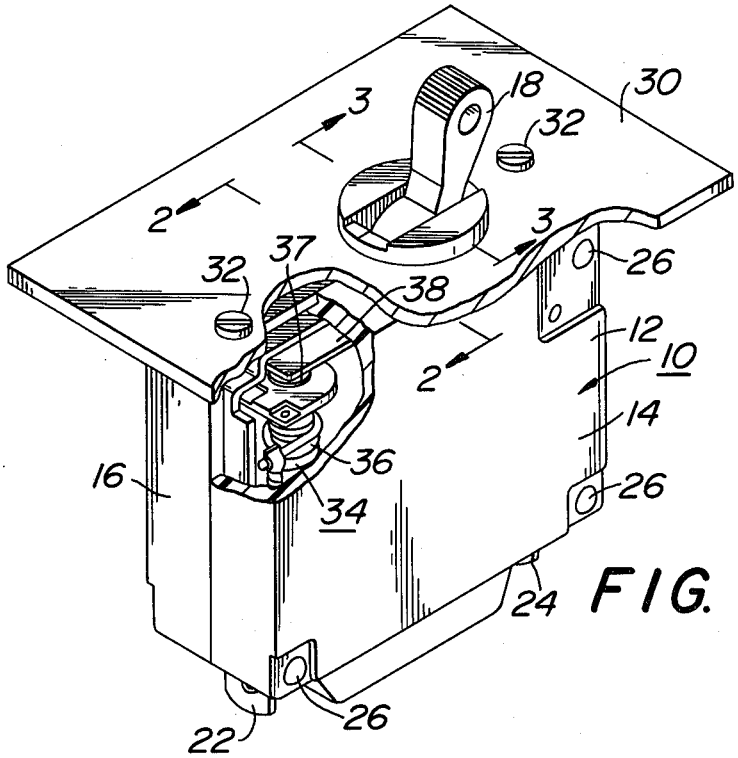
FIG. 1 is a side and top perspective view of a molded case circuit breaker incorporating the present invention secured to a panel with one corner portion of the case being broken away to show part of the internal mechanism.

Referring to the drawings, a circuit breaker 10 including a case 12 is illustrated in FIG. 1. The circuit breaker 10 is molded from a suitable electrical insulation material, as is well known, and the case 12 comprises two substantially half-cases 14 and 16 which abut each other, as shown, to house the internal parts of the circuit breaker 10. The half-cases 14 and 16 define a suitable opening through which extends the handle 18 of the circuit breaker 10. Suitable terminals 22 and 24 extend from the case 12 to connect the circuit breaker to a suitable circuit.

The half-cases 14 and 16 are secured together by three rivets 26 which extend through suitable holes in the half-cases 14 and 16. The case 12 is secured to a panel 30 by suitable screws 32, as is well known.

Figure 2:
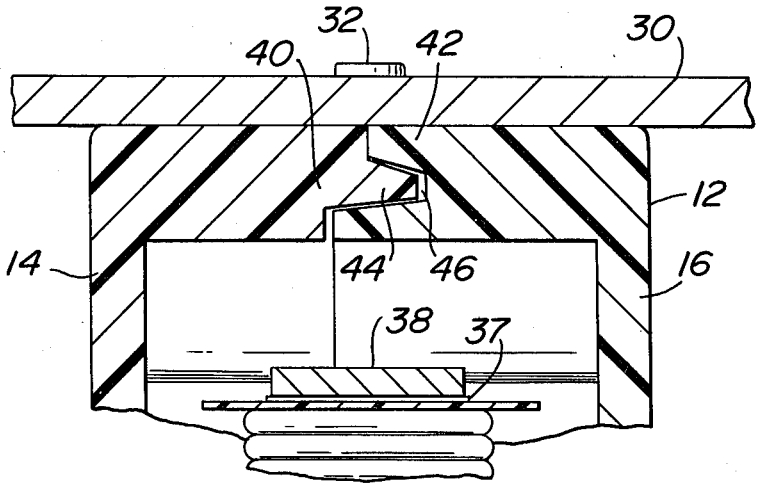
FIG. 2 is a partial cross-sectional view taken along the line 2—2 in FIG. 1.

The circuit breaker 10 includes an electromagnetic device 34 well known in the art, comprising a solenoid coil 36, a pole piece 37, and a metallic armature 38. The pole piece 37 and the armature 38 are electrically energized so that potentially hazardous creepage and clearance paths exist between the panel 30 and the closest parts of the pole piece 37 and of the armature 38. To increase the creepage and clearance distances the abutting walls 40 and 42 of the half-cases 14 and 16 overlying and embracing the pole piece 37 and the armature 38 are formed with a tongue 44 interfitting with a groove 46. The tongue 44 and groove 46 are slightly inclined or V-shaped, as shown, with the base of the "V" being preferably truncated for ease in manufacture. Thus, as shown in FIG. 2, a tortuous path is provided from the plane where the underside of the panel 30 abuts the case 12 to the nearest point of either the pole piece 37 or the armature 38 which is sufficiently long to comply with the safety standards of IEC and VDE, i.e., at least 8 mm in length.

Figure 3:
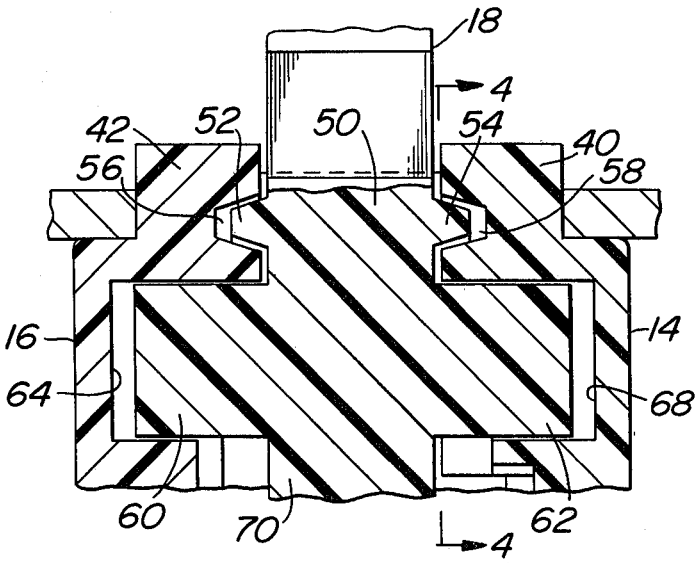
FIG. 3 is a partial cross-sectional view taken along the line 3—3 in FIG. 1.
Figure 4:
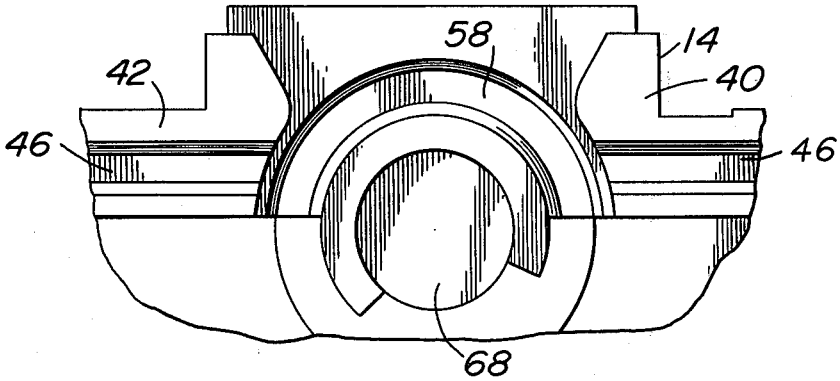
FIG. 4 is a partial elevation view taken along the line 4—4 in FIG. 3.

Likewise, referring to FIGS. 3 and 4, a further source of potentially hazardous creepage and clearance paths is the area of the abutting half-cases 12 and 14 abutting a link 50 with which the handle 18 is integral. The link 50 is provided with semicircular ribs 52 and 54 interfitting with a mating semicircular groove 56 formed in the abutting wall 42 of the half-case 16 and with a mating semi-circular groove 58 formed in the abutting wall 40 of the half-case 14, respectively, to form tongue and groove connections on opposite sides of the link 50.

Further, the link 50 is formed on opposite sides with integral pintles 60 and 62 pivotally received in mating openings or recesses 64 and 68 formed in the half-cases 14 and 16, as shown in FIG. 3. The lower portion 70 of the link 50 is connected to the toggle linkage (not shown) to actuate the mechanism (not shown) of the circuit breaker.

Thus, as best understood from FIG. 4, the semi-circular ribs 54 and grooves 58 (of the handle 18 and the half-cases 14 and 16) are disposed between the tongues 44 and grooves 46 of the half-cases 14 and 16 which extends away from the handle 18 and on either side thereof providing a tongue and groove type barrier and circuitous creepage and clearance paths across virtually the entire zone between the operator accessible part of the circuit breaker, i.e., the upper part of the case 12 which is fastened to the panel 30, and the closest electrically energized parts within the circuit breaker, for example, the armature 38.

What I claim is:

1. In a circuit breaker the combination of a case, two half-cases abutting together to jointly form said case, a link including a handle accessible to an operator, an electromagnetic device within said case, said electromagnetic device including a portion which is electrically energized and closest to the outside of the circuit breaker, a mechanism within said case operated by said handle, said half-cases defining an opening through which said handle extends, said half-cases having abutting, interfitting tongue and groove portions adjacent to said operator accessible handle to increase the creepage and clearance distances from outside the circuit breaker to said portion which is electrically energized and closest to the outside of the circuit breaker.

2. The combination of claim 1 wherein said link and said half-cases include tongue and groove portions having an interfitting semi-circular connection in which said link is pivotable adjacent to said operator accessible handle, and said tongue and groove connection of said half-cases is disposed on both sides of said semi-circular connection and adjacent thereto so as to form a tongue and groove connection both at the opening of the case through which said link extends and on either side thereof.

3. The combination of claims 1 or 2 wherein said link has pintles extending therefrom on opposite sides, and said half-cases are provided with recesses to pivotally receive said pintles.

4. A method of increasing operator safety in the operation of an electrical circuit breaker comprising providing the circuit breaker with an operator accessible handle, forming the circuit breaker with a two-part case, abutting the two parts of said two-part case, and making abutting portions of said two part case with interfitting portions which define a circuitous creepage and clearance path from the operator accessible portion of the circuit breaker to the closest portion thereof which is electrically energized.

* * * * *